US005729803A

United States Patent [19]

Nakaue et al.

[11] Patent Number: 5,729,803

[45] Date of Patent: Mar. 17, 1998

[54] DEVICE FOR DEVELOPING ELECTROSTATIC LATENT IMAGE WHICH PREVENTS SOLIDIFICATION OF DEVELOPING AGENT BY VIBRATION

[75] Inventors: Takahisa Nakaue; Masanobu Maeshima; Akinobu Nakahata; Takeshi Aoki; Hiroshi Inui, all of Osaka, Japan

[73] Assignee: Mita Industrial Co., Ltd., Osaka, Japan

[21] Appl. No.: 734,856

[22] Filed: Oct. 23, 1996

[30] Foreign Application Priority Data

Nov. 10, 1995 [JP] Japan ..... 7-317186

[51] Int. Cl.[6] ..... G03G 15/08

[52] U.S. Cl. ..... 399/261; 222/DIG. 1; 399/260

[58] Field of Search ..... 399/261, 258, 399/260; 221/DIG. 1

[56] References Cited

U.S. PATENT DOCUMENTS 4,692,017 9/1987 Maczuszenko et al. ..... 399/253

4,723,143 2/1988 Enomoto ..... 399/254

4,832,233 5/1989 Ichihara et al. ..... 222/201

*Primary Examiner*—Arthur T. Grimley

*Assistant Examiner*—Quana Grainger

*Attorney, Agent, or Firm*—Beveridge, DeGrandi, Weilacher & Young, LLP

[57] ABSTRACT

A device for developing an electrostatic latent image including a developing housing having a developing chamber, a stirrer chamber, and a developing agent-feeding port communicating with the stirrer chamber. A developing roller is disposed in the developing chamber to hold, on the peripheral surface thereof, a developing agent in a developing agent-holding zone, and convey the thus held developing agent to a developing zone to apply it to the electrostatic latent image. A replenishing device feeds the developing agent onto the peripheral surface of the developing roller in the developing agent-holding zone. A stirring device disposed in the stirrer chamber stirs the developing agent that is fed through the developing agent-feeding port and sends the stirred developing agent to the developing chamber. A vibration plate having a plurality of developing agent-flow ports is disposed at the developing agent-feeding port of the developing housing, and the stirring device is caused to act on the vibration plate.

2 Claims, 5 Drawing Sheets

DEVICE FOR DEVELOPING ELECTROSTATIC LATENT IMAGE WHICH PREVENTS SOLIDIFICATION OF DEVELOPING AGENT BY VIBRATION

FIELD OF THE INVENTION

The present invention relates to a device for developing electrostatic latent images into toner images in an image-forming machine such as an electrostatic copying machine or laser printer.

DESCRIPTION OF THE PRIOR ART

There has been widely used a device for developing electrostatic latent images of the type in which the electrostatic latent image in an image-forming machine is developed into a toner image using a developing agent consisting of a one-component toner. The device for developing electrostatic latent image of this type comprises a developing housing having a developing chamber, a stirrer chamber and a developing agent-feeding port communicated with the stirrer chamber; a developing roller disposed in the developing chamber to hold, on the peripheral surface thereof, a developing agent in a developing agent-holding zone, and convey the thus held developing agent to a developing zone to apply it to the electrostatic latent image; a replenishing roller disposed in the developing chamber to serve as a feeding means for feeding the developing agent onto the peripheral surface of the developing roller in the developing agent-holding zone; a stirring means disposed in the stirrer chamber to stir the developing agent that is fed through the developing agent-feeding port and send the stirred developing agent to the developing chamber; and a limiting means which acts on the peripheral surface of the developing roller and limits the amount of the developing agent held on the surface in a developing agent-limiting zone located between the developing agent-holding zone and the developing zone.

In the apparatus for developing electrostatic latent image of this type, the developing agent fed into the stirrer chamber through the developing agent-feeding port is stirred by the stirring means. The stirring means needs a considerably large drive torque for stirring the developing agent. Besides, though the developing agent is stirred over a range in which the stirring means passes, the developing agent near the developing agent-feeding port where the stirring means does not pass tends to be solidified when the developing agent is consumed in small amounts.

SUMMARY OF THE INVENTION

The object of the present invention is to provide a device for developing electrostatic latent image, which by giving vibration to the developing agent in a stirrer chamber and particularly, near the developing agent-feeding port, decreases the drive torque exerted on a stirring means and prevents the developing agent near the developing agent-feeding port from being solidified.

In order to accomplish the above-mentioned object, the present invention provides a device for developing electrostatic latent image comprising a developing housing having a developing chamber, a stirrer chamber and a developing agent-feeding port communicated with the stirrer chamber; a developing roller that is disposed in the developing chamber and holds, on the peripheral surface thereof, a developing agent in a developing agent-holding zone, and conveys the thus held developing agent to a developing zone to apply it to the electrostatic latent image; a replenishing means for feeding the developing agent onto the peripheral surface of the developing roller in the developing agent-holding zone; and a stirring means disposed in the stirrer chamber to stir the developing agent that is fed through the developing agent-feeding port and to send the stirred developing agent to the developing chamber, wherein a vibration plate having a plurality of developing agent-flow ports is disposed at the developing agent-feeding port of the developing housing, and the stirring means is caused to act on the vibration plate.

According to the present invention, furthermore, there is provided a device for developing electrostatic latent image wherein the vibration plate is made of a resilient sheet member and includes a mounting portion and a vibration portion formed continuously to the mounting portion, the vibration portion is provided with a plurality of engaging portions formed in a protruding manner, and the stirring means is caused to act on the plurality of engaging portions.

DETAILED DESCRIPTION OF THE PREFERRED EMBODIMENTS

A preferred embodiment of the device for developing electrostatic latent image constituted according to the present invention will now be described in further detail with reference to the accompanying drawings.

Figure 1:
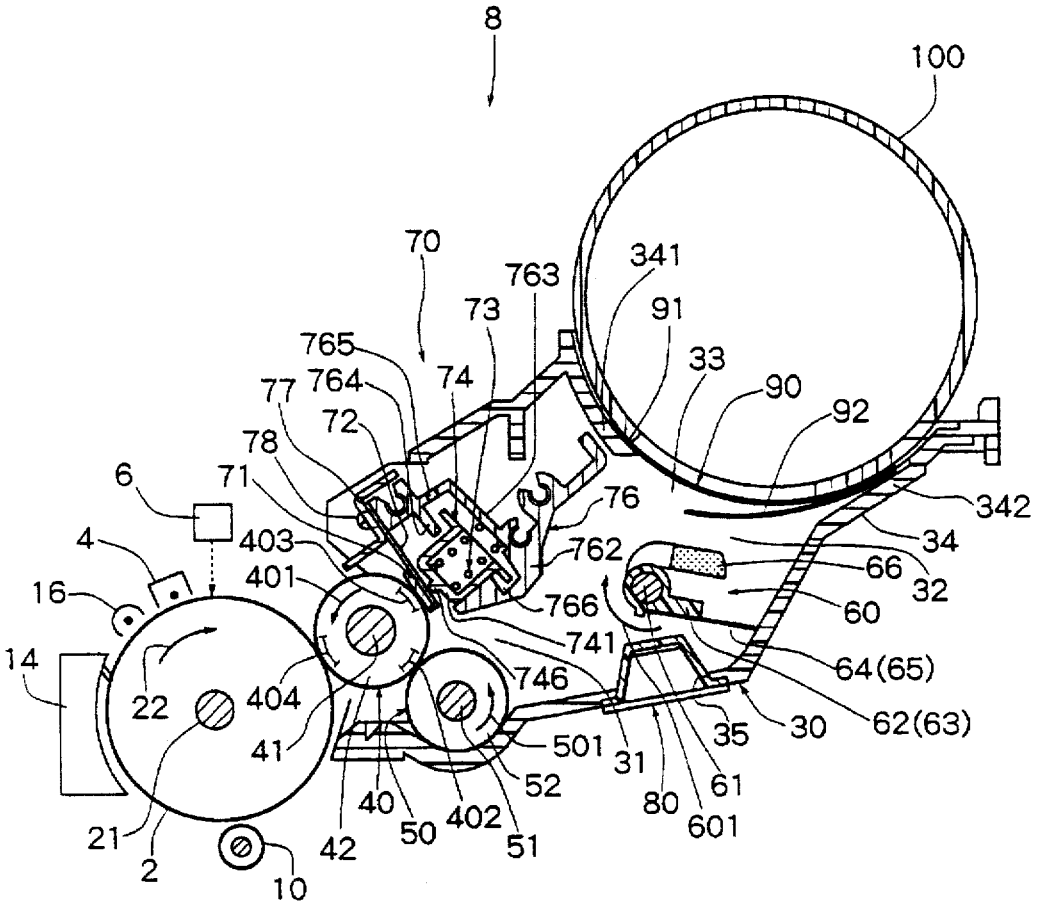
FIG. 1 is a sectional view schematically illustrating the constitution of an image-forming machine equipped with a device for developing electrostatic latent image constituted according to an embodiment of the present invention.

FIG. 1 illustrates an image-forming machine equipped with the device for developing electrostatic latent image constituted according to the present invention. The illustrated image-forming machine is equipped with a rotary drum 2 having, arranged on the peripheral surface thereof, an electrostatic photosensitive material that serves as an image carrier. The rotary drum 2 is mounted by means of a rotary shaft 21 in a machine housing that is not shown, and is allowed to freely rotate. Around the rotary drum 2 that rotates in a direction of an arrow 22, there are arranged a corona discharger 4 for charging the photosensitive layer of the rotary drum to a particular polarity, a laser optical device 6 which is an exposure means for forming an electrostatic latent image on the photosensitive layer of the rotary drum 2 charged to the particular polarity by the corona discharger, a device 8 for developing electrostatic latent image formed by a laser beam irradiated from the optical device 6 into a toner image, a transfer roller 10, a cleaning device 14 and a charge-removing lamp 16, as viewed in a direction of rotation.

The device 8 for developing electrostatic latent image is equipped with a developing housing 30 that can be formed of a synthetic resin. In the developing housing 30 are arranged a developing roller 40, a replenishing roller 50 serving as a developing agent feeding means, a stirring means 60 and a developing agent-limiting means 70. On the developing housing 30 is mounted a toner cartridge 100 as a developing agent container.

Figure 2:
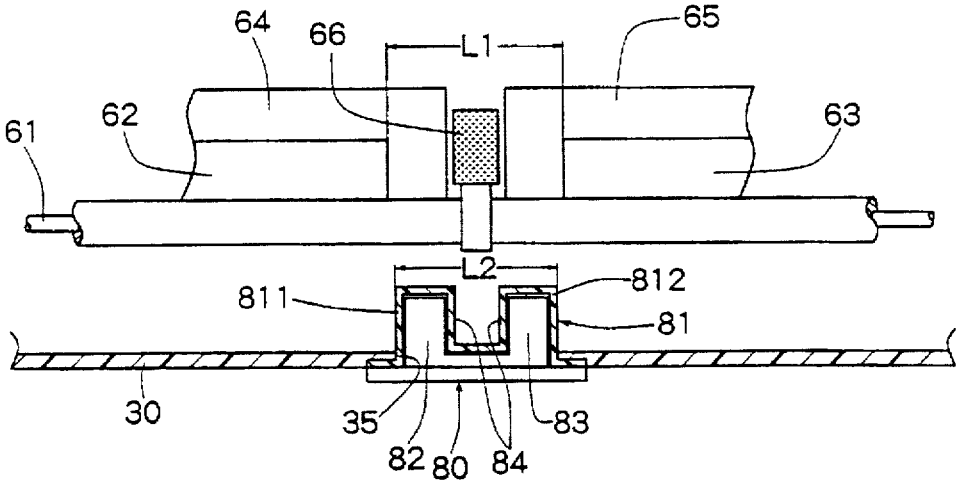
FIG. 2 is a sectional view illustrating a relationship between a stirring means mounted on the device for developing electrostatic latent image shown in FIG. 1 and a developing agent detecting sensor mounted on the developing housing.

The developing housing 30 is formed of a synthetic resin, and has a developing chamber 31 and a stirrer chamber 32. The developing housing 30 is provided at an upper portion thereof with a toner cartridge-mounting portion 34 having a developing agent feed port 33, and a toner cartridge 100 is mounted on the mounting portion 34. Further, an opening 35 for mounting the developing agent detecting sensor is formed, opposed to the stirring means 60, in nearly the central portion of the developing housing 30 in the direction of width. On the opening 35 is mounted a developing agent detecting sensor 80. As shown in FIG. 2, the developing agent detecting sensor 80 is constituted by a sensor case 81 formed of a transparent synthetic resin having two protrusions 811 and 812 formed at a predetermined distance, a light-emitting element 82 arranged in one protrusion 811 of the sensor case 81, and a light-receiving element 83 arranged in the other protrusion 812 of the sensor case 81. The thus constituted developing agent sensor 80 detects the developing agent that exists between the developing agent detector units 84 and 84 formed on the two protrusions 811 and 812 of the sensor case 81, and sends a detection signal to a control means that is not shown.

The developing roller 40 is disposed in the developing chamber 31 in the developing housing 30, and includes a rotary shaft 41 that is supported between both side walls (not shown) of the developing housing 30 so as to rotate and a solid synthetic rubber roller 42 fitted to the outer peripheral surface of the rotary shaft 41. The rotary shaft 41 can be made of a suitable metal material such as stainless steel. The solid synthetic rubber roller 42 is constituted by a relatively soft material having electrically conducting property or an electrically conducting solid synthetic rubber such as urethane rubber. In the illustrated embodiment, the peripheral surface of the solid synthetic rubber roller 42 has a roughness, i.e., a ten-point average roughness Rz as stipulated under JIS B 0601, of 5.0 to 12.0. The solid synthetic rubber roller 42 has a volume resistivity of from about $10^6$ to about $10^9$ Ω.cm. In the developing roller 40 constituted by the rotary shaft 41 made of a metal material and the solid synthetic rubber roller 42 fitted to the outer peripheral surface of the rotary shaft 41, the rotary shaft 41 has an outer diameter of, for example, 8 to 10 mm and the solid synthetic rubber roller 42 has an outer diameter of, for example, 16 mm. When the rotary shaft 41 has an outer diameter of 8 mm, therefore, the solid synthetic rubber roller 42 has a thickness of 4 mm in the radial direction and when the rotary shaft 41 has an outer diameter of 10 mm, the solid synthetic rubber roller 42 has a thickness of 3 mm in the radial direction. Hence, when a rubber constituting the solid synthetic rubber roller 42 has the same hardness, the hardness of the developing roller as an assembly varies. That is, the hardness of the developing roller using the rotary shaft of an outer diameter of 8 mm becomes smaller than that of the developing roller using the rotary shaft of an outer diameter of 10 mm. In the illustrated embodiment, the developing roller, as an assembly, constituted by the rotary shaft 41 and the solid synthetic rubber roller 42 fitted to the outer peripheral surface of the rotary shaft 41 has a hardness of from 60 to 80 in terms of Asker's C hardness. The roller 42 of the thus constituted developing roller 40 is exposed through the opening formed in the developing housing 30 and is positioned being opposed to the rotary drum 2. The peripheral surface of the roller 42 constituting the developing roller 40 is brought into pressed contact with the peripheral surface of the rotary drum 2, and is elastically compressed to some extent in the press-contacted region. The rotary shaft 41 of the developing roller 40 is continuously rotated by a drive means that is not shown, in a direction indicated by an arrow 401 in FIG. 1. With the rotation of the rotary shaft 41, the roller 42 is also continuously rotated in the direction indicated by the arrow 401, and the peripheral surface of the roller 42 passes through a developing agent-holding zone 402, developing agent-limiting zone 403 and developing zone 404, successively. In the illustrated embodiment, a constant voltage of 300 V is applied to the rotary shaft 41 of the developing roller 40.

The replenishing roller 50 is disposed, in parallel with the developing roller 40, in the developing chamber 32 in the developing housing 30 and includes a rotary shaft 51 supported between both side walls (not shown) of the developing housing 30 so as to rotate and a roller 52 fitted to the outer peripheral surface of the rotary shaft 51. Like the rotary shaft 41 of the developing roller 40, the rotary shaft 51 can be made of a suitable metal material such as stainless steel. The roller 52 is constituted by a foamed material such as foamed silicon or foamed urethane. The roller 52 is brought into pressed contact with the roller 42 of the developing roller 40. The foamed material constituting the roller 52 has a hardness (e.g., Asker's C hardness of about 35) which is considerably smaller than that of the roller 42 of the developing roller 40. It is desired that the roller 52 that is brought into pressed contact with the roller 42 of the developing roller 40 is elastically compressed by about 0.1 to 0.6 mm in the press-contacted region. The roller 52, too, has electrically conducting property, and has a volume resistivity of from about $10^6$ to about $10^9$ Ω.cm. The roller is continuously rotated by a drive means that is not shown in a direction indicated by an arrow 501 in FIG. 1. In the illustrated embodiment, the rotary shaft 51 of the developing roller 50 is impressed with a constant voltage of 450 V which is higher than the voltage applied to the developing roller 40.

The stirring means 60 is disposed, in parallel with the replenishing roller 52, in the stirrer chamber 32 of the developing housing 30 and includes a rotary shaft 61 supported between both side walls (not shown) of the developing housing 30 so as to rotate, two stirrer members 62 and 63 fitted to the rotary shaft 61, and two stirrer sheet members 64 and 65 having been elasticity mounted on each of the stirrer members 62 and 63. The two stirrer members 62 and 63 are formed of a synthetic resin, and are so arranged that their inner ends opposed to each other at a predetermined distance L1 at the central portion of the rotary shaft 61. The distance L1 is slightly larger than the width L2 of the developing agent detecting sensor 80, so that, when the stirring means 60 is operated, the inner ends of the stirrer members 62 and 63 will not interfere the developing agent detecting sensor 80. The ends on the other side of the stirrer sheet members 64 and 65 protrude beyond the stirrer members 62 and 63 in the radial direction. The inner ends of the stirrer sheet members 64 and 65 are inwardly protruding beyond the inner ends of the stirrer members 62 and 63. At the center of the rotary shaft 61 is disposed a cleaning member 66 for cleaning the developing agent detector units 84 and 84 formed on the two protrusions 811 and 812 of the sensor case 81 that constitutes the developing agent detecting sensor 80. A foamed material is fitted onto the surface of the cleaning member 66. The thus constituted stirring means 60 is continuously rotated by a drive means that is not shown, in a direction indicated by an arrow 601 in FIG. 1.

Figure 3:
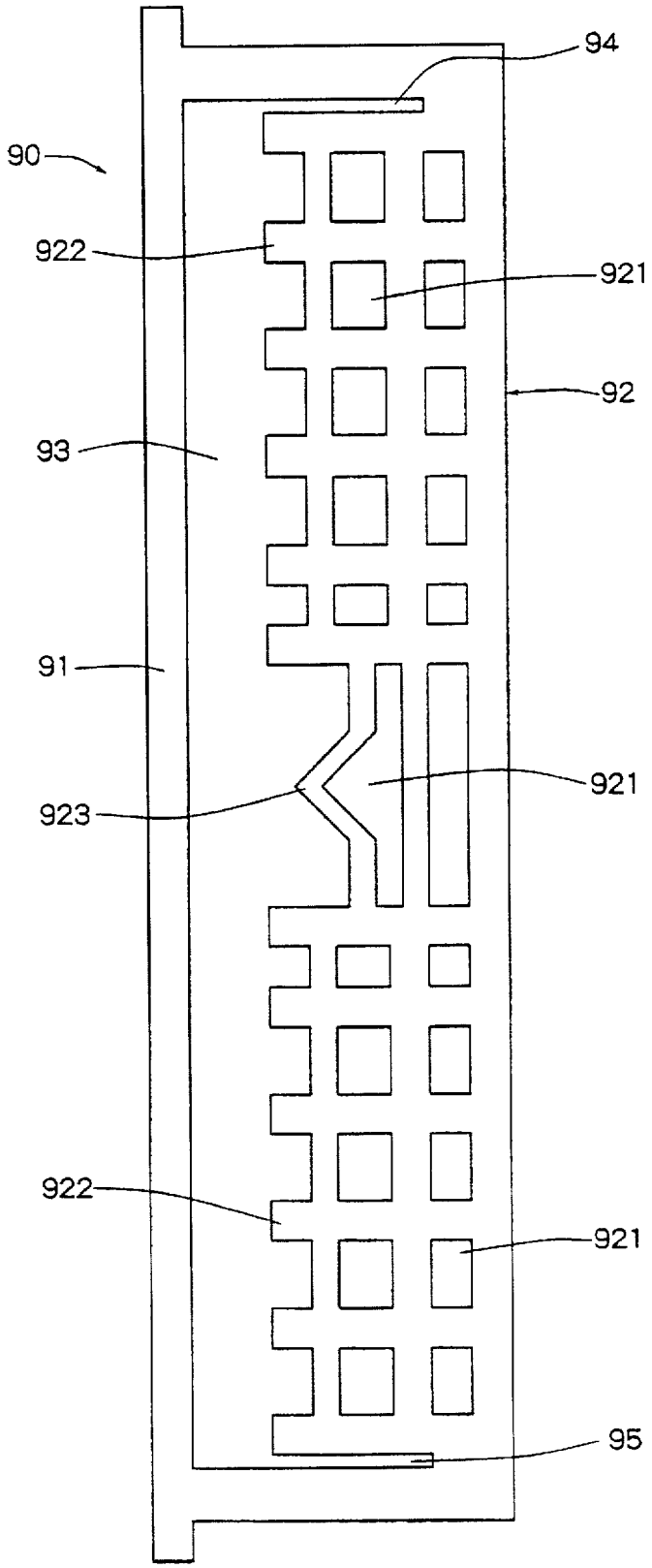
FIG. 3 is a plan view of a vibration plate mounted on the device for developing electrostatic latent image shown in FIG. 1.
Figure 4:
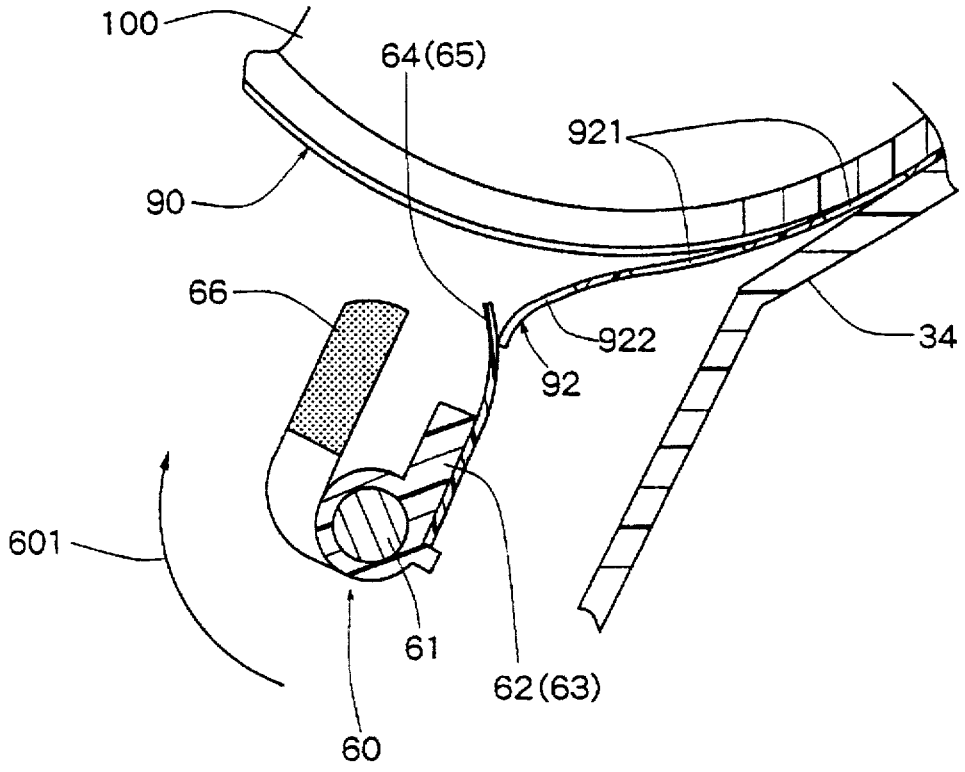
FIG. 4 is an explanation view illustrating, on an enlarged scale, a state where the stirring means acts on the vibration plate mounted on the device for developing electrostatic latent image of FIG. 1.

A vibration plate 90 is disposed in a developing agent-feeding port 33 of the developing housing 30. The vibration plate 90 is made of a resilient sheet member such as polyethylene terephthalate (PETP) resin film. Referring to FIG. 3, the vibration plate 90 is constituted by a mounting portion 91 having a length corresponding to the width of the toner cartridge-mounting portion 34 formed in the developing housing 30, and a vibration portion 92 formed continuing to the mounting portion 91. Between the vibration portion 92 and the mounting portion 91 is formed a developing agent-flow port 93. Slits 94 and 95 connected to the developing agent-flow port 93 are formed at both ends of the vibration portion 92. A plurality of developing agent-flow ports 921 are formed in the vibration portion 92. A plurality of first engaging portions 922 are formed, in a protruding manner, at one end of the vibration portion 92 (on the side end of the developing agent-flow port 93). Furthermore, a second engaging portion 923 is formed at the center of the vibration portion 92 on the side end of the developing agent-flow port 93, the second engaging portion 923 being more on the other side than the first engaging portions 922. The thus constituted vibration plate 90 is mounted at its mounting portion 91 on one mounting portion 341 of the toner cartridge mounting portion 34 which forms the developing agent-feeding port 33 by a fastening means such as adhesive, and is mounted at the other end of the vibration portion 92 on the other mounting portion 342 of the toner cartridge mounting portion 34. The thus mounted vibration plate 90 has the vibration portion 92 that is downwardly bent between the slits 94 and 95 due to its own weight, as shown in FIG. 1. When the toner cartridge 100 is mounted on the toner cartridge-mounting portion 34, the toner which is the developing agent contained in the toner cartridge 100 is fed into the stirrer chamber 32 passing through the developing agent-flow port 93 and the developing agent-flow ports 921 formed in the vibration plate 90. In this state, when the stirring means 60 is rotated in a direction indicated by an arrow 601, the ends of the stirrer sheet members 64 and 65 come into engagement with the first engaging portions 922 of the vibration portion 92 as shown in FIG. 4, causing the engaging portions 922 to be resiliently deformed. When they are disengaged from each other, the vibration portion 92 vibrates due to the restoring force of the resiliently deformed engaging portions 922. As the stirring means 60 further rotates in the direction indicated by the arrow 601, the end of the cleaning member 66 disposed at the central portion comes into engagement with the second engaging portion 923 formed at the central portion of the vibration portion 92, and the vibration portion 92 vibrates. Thus, the vibration portion 92 of the vibration plate 90 vibrates by the action of the stirrer sheet members 64, 65 and by the cleaning member 66 every time when the stirring means 60 rotates once. Accordingly, vibration is given to the developing agent near the developing agent-feeding port 33. Since the developing agent is vibrating at all times, it is made possible to reduce the drive torque born by the stirring means 60 and to prevent the developing agent from being solidified at the neighborhood of the developing agent-feeding port 33.

Next, the developing agent-limiting means 70 will be described with reference to FIGS. 1, 2, 6 and 7. The developing agent-limiting means 70 comprises a flexible blade 71 brought into pressed contact with the peripheral surface of the roller 42 which constitutes the developing roller 40, a flexible support plate 72 constituting a support means of the blade 71, a resilient urging means 73 that pushes one surface of the blade 71 toward a direction to come into pressed contact with the peripheral surface of the roller 42, and a support holder 76 for supporting the blade 71, support plate 72 and resilient urging means 73.

The support holder 76 is formed by, for example, extrusion-molding an aluminum alloy. The support holder 76 has a length in the direction of width which corresponds to a distance between both side walls of the developing housing 30, and comprises an upper wall 761 for mounting the upper end of the support plate 72, a lower wall 762 formed at a predetermined distance from the upper wall 761, and a rear wall 763 that connects the upper wall 761 to the rear end of the lower wall 762. In the intermediate portion of the upper wall 761 is provided a guide rail 764 that protrudes inwardly and extends in the direction of the whole width, and a plurality of pin-insertion holes (three holes in the illustrated embodiment) 765 are formed between the guide rail 764 of the upper wall 761 and the rear wall 763. In the lower wall 762 is formed a guide groove 766 at a position that corresponds to the guide rail 764, the guide groove 766 extending in the direction of the whole width. The thus constituted support holder 76 is disposed at a predetermined position between both side walls of the developing housing 30, and is mounted on the developing housing 30 by a fastening means such as tightening bolts (not shown) that is fitted penetrating through both side walls of the developing housing 30.

The flexible blade 71 has a length in the direction of width which corresponds to the length of the roller 42 that constitutes the developing roller 40, and has at least one surface thereof (surface brought into pressed contact with the peripheral surface of the roller 42 constituting the developing roller 40) constituted by a flat plate-like member that extends in the direction of width (direction perpendicular to the surface of the paper in FIG. 1) along the peripheral surface of the roller 42. It is desired that at least the region of one surface of the blade 71 brought into pressed contact with the peripheral surface of the roller 42 has a sufficiently small surface roughness and a ten-point average roughness (Rz) stipulated under JIS B 0601 of from 5.0 to 12.0. As the surface roughness on one surface of the blade becomes too great, the surface of the toner layer formed on the peripheral surface of the roller 42 that constitutes the developing roller 40 is not flattened to a sufficient degree and is liable to be nonuniform. A sheet glass placed in the market can be exemplified as a suitable material that can be used as the blade 71 relatively cheaply yet exhibiting a sufficiently small roughness, a high hardness and a large abrasion resistance. The sheet glass having a thickness of about 0.5 to 2.0 mm can be used. According to experiment conducted by the present inventors, it was found that the sheet glass constituting the blade 71 having a thickness not larger than 0.5 mm is likely to be cracked during the operation, and the sheet glass having a thickness of not smaller than 2.0 mm makes it difficult to obtain a predetermined flexibility. When it is desired to apply a required voltage to the blade 71 to control the charging property of the toner, an electrically conducting film may be applied to one surface of the sheet glass. The blade 71 can also be constituted by using a suitable flexible metal plate such as of a stainless steel in place of using the sheet glass. To sufficiently decrease the surface roughness on one surface of the metal plate constituting the blade 71, a suitable surface treatment may be effected for one surface of the metal plate, as required.

Figure 5:
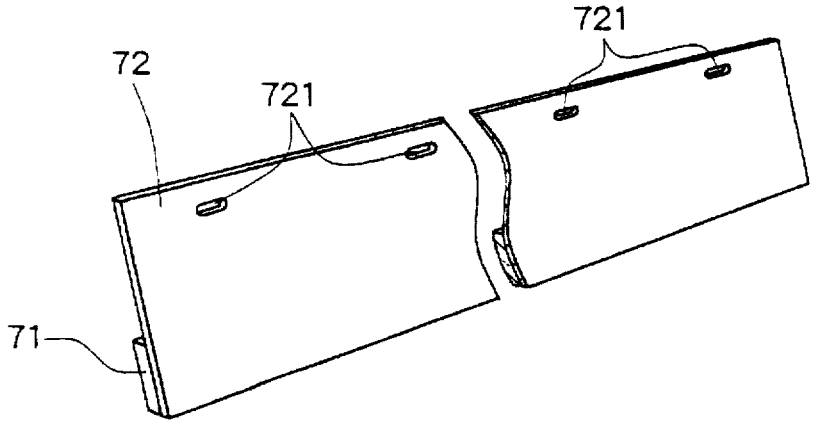
FIG. 5 is a perspective view of a blade and a support plate constituting a developing agent-limiting means mounted on the device for developing electrostatic latent image shown in FIG. 1.

In the illustrated embodiment, the support plate 72 is constituted by a plate spring member such as thin spring steel plate or thin stainless steel plate, and has a length in the direction of width nearly the same as that of the blade 71. The support plate 72 must have flexibility and, hence, it is desired to use a steel plate having a thickness of about 0.1 mm. As shown in FIG. 5, the support plate 72 has a plurality of oval holes 721 (five holes in the illustrated embodiment) formed in the upper end portion thereof at a predetermined distance in the direction of width. The thus constituted support plate 72 is fastened at the surface of the lower end thereof to the other surface of the blade 71 by a fastening means such as adhesive agent. When it is desired to apply a required voltage to the blade 71 to control the charging property of the toner, an electrically conducting adhesive is used as the fastening means thereby to allow to apply the required voltage to the blade 71 through the support plate 72. As described above, the support plate 72 fastened to the other surface of the blade 71 is fastened and supported by using screws 78 that engage, through a patch 77 and the holes 721, with the end surface of the upper wall 761 that constitutes the support holder 76 at the upper end thereof.

The pushing member 74 has a length in the direction of the width which is nearly the same as that of the blade 71 and has the shape of a hat in cross section of which the rear end is opened, and is constituted by a front wall 741 opposed to the support plate 72, an upper wall 742, a lower wall 743, and guide support portions 744 and 745 that extend upwards and downwards from the rear ends of the upper wall 742 and the lower wall 743, respectively. A protrusion (elongated protrusion) 746 is formed on the front surface of the front wall 741 to constitute a pushing portion at an intermediate portion in the up-and-down direction over the whole width. Between the upper wall 742 and the lower wall 743, furthermore, there are formed a plurality of spring-fitting chambers 749 (six chambers in the illustrated embodiment) by partitioning walls 747 and 748 formed at an equal distance in the direction of width, and a compression coil spring 731 that constitutes the resilient urging means 73 is fitted in each of the chambers. The thus constituted pushing member 74 is molded as a unitary structure using, for example, a synthetic resin. It is important that the pushing member 74 has flexibility.

The resilient urging means 73 comprises a plurality of compression coil springs 731 (six compression coil springs in the illustrated embodiment). The ends on one side of the compression coil springs are fitted to the plurality of spring-fitting chambers formed in the pushing member 74, and the ends on the other side thereof are brought into contact with the front surface of the rear wall 763 which constitutes the support holder 76. Being constituted as described above, the pushing forces of the plurality of compression coil springs 731 arranged at an equal distance in the direction of width of the pushing member 74 act on the blade 71 through the pushing member 74 and the support plate 72, so that one surface of the blade 71 is brought into pressed contact with the surface of the roller 42 that constitutes the developing roller. Here, since the pushing member 74, support plate 72 and blade 71 have flexibility, the one surface of the blade 71 is brought into uniformly pressed contact with the surface of the roller 42 constituting the developing roller 40 over the whole width even though the shaft of the developing roller 40 is deflected to some extent. The support plate 72 fitted to the blade 71 is pushed by a protrusion 746 formed on the front surface of the front wall 741 constituting the pushing member 74, and receives a uniform pushing force stably over the whole width since the contact area of the protrusion 746 to the support plate 72 is small. The pressing force of the blade 71 acting on the peripheral surface of the roller 42 constituting the developing roller 40 can be suitably set depending upon the thickness of the developing agent layer that is to be formed on the peripheral surface of the roller 42. The thickness of the developing agent layer formed on the peripheral surface of the roller 42 decreases with an increase in the pressing force. As the pressing force becomes excessive, on the other hand, smooth rotation of the roller 42 is likely to be impaired. In the developing system of the illustrated embodiment, in general, the toner layer formed on the peripheral surface of the roller 42 is from about 20 to about 35 μm. To suitably form the developing agent layer having such a thickness, the blade 71 should be brought into pressed contact with the peripheral surface of the roller 42 with a line pressure (pressure per a unit length in the direction of width) of from 4.0 to 12.0 g/mm.

It is desired that the lower end of the blade 71 is slightly protruded toward the upstream side, as viewed in the direction in which the roller 42 moves, beyond a portion where the blade 71 is brought into pressed contact with the roller 42 constituting the developing roller 40. It is desired that the length of such protrusion of the lower end of the blade 71 (i.e., the length from the center of contact between the roller 42 and the blade 71 to the lower end of the blade 71) is, usually, from 0.5 to 2.0 mm. When the length of the protrusion is very short and becomes substantially zero, the limiting action by the blade 71 becomes so excessive that it becomes difficult to form a favorable developing agent layer. When the length of the protrusion becomes too long, on the other hand, the thickness of the developing agent layer that is formed becomes too great, and the amount of electric charge of the toner tends to become too small.

Figure 6:
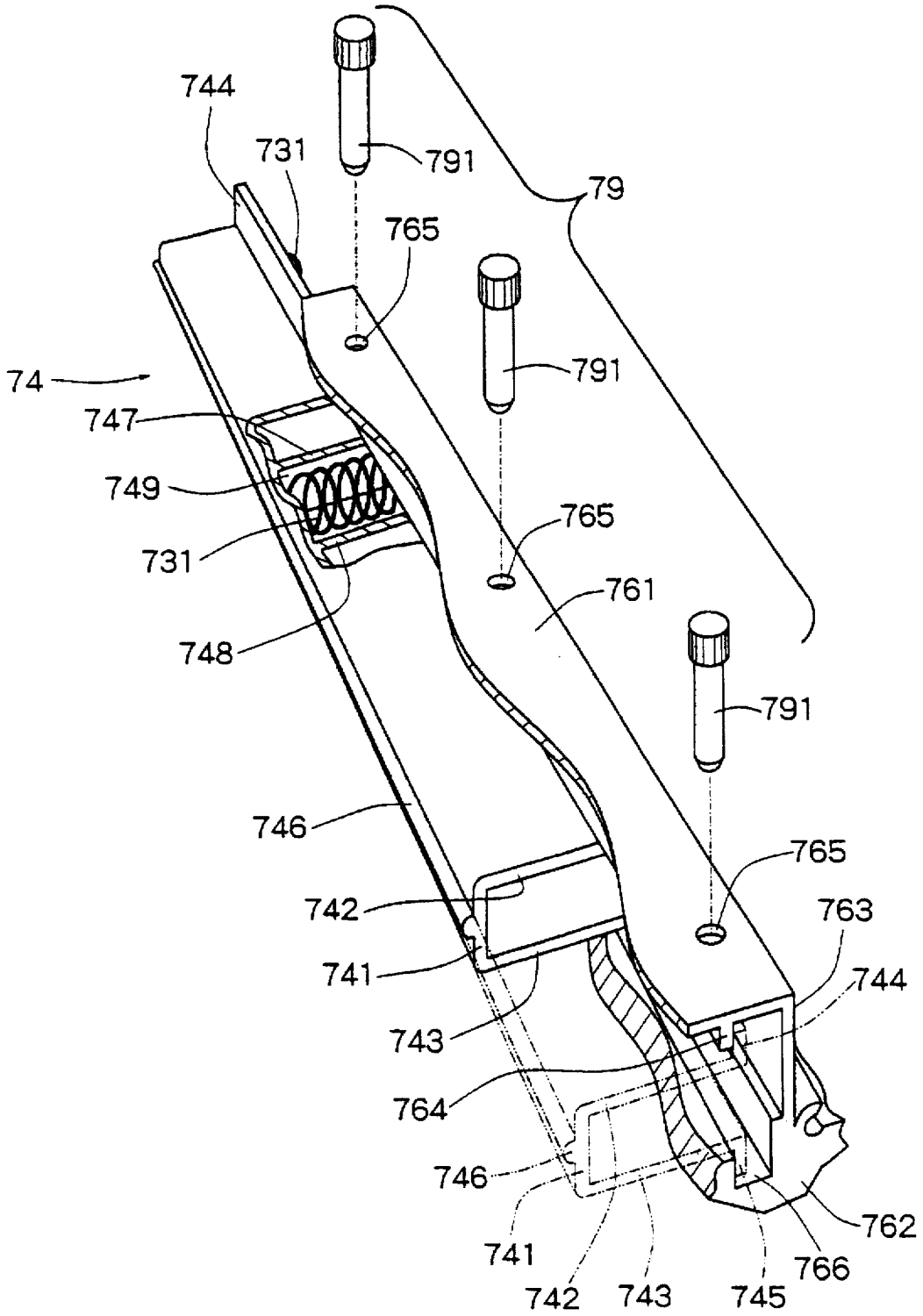
FIG. 6 is a perspective view illustrating, partly in a cut-away manner, major portions of the developing agent-limiting means mounted on the device for developing electrostatic latent image shown in FIG. 1.

The developing agent-limiting means 70 has a pressure-canceling means 79 for canceling the pressure exerted on the support plate 72 and on the blade 71 by the resilient urging means 73. In the illustrated embodiment, the pressure-canceling means 79 has three stopper pins 791. At the time of assembling the developing agent-limiting means 70, the three stopper pins 791 are inserted, as shown in FIG. 6, in the three pin-insertion holes 765 formed between the rear wall 763 and the guide rail 764 of the upper wall 761 that constitutes the support holder 76, and act on the front surface of the guide support portion 744 that constitutes the pushing member 74 to cancel the pressing force of the resilient urging means 73 acting on the back surface of the support plate 72. After the developing agent-limiting means 70 is assembled on a predetermined portion of the developing device 8, the three stopper pins 791 are removed from the pin-insertion holes 765, so that the pushing forces of the compression coil springs 751 act on the back surface of the support plate 72 as shown in FIG. 1.

Figure 7:
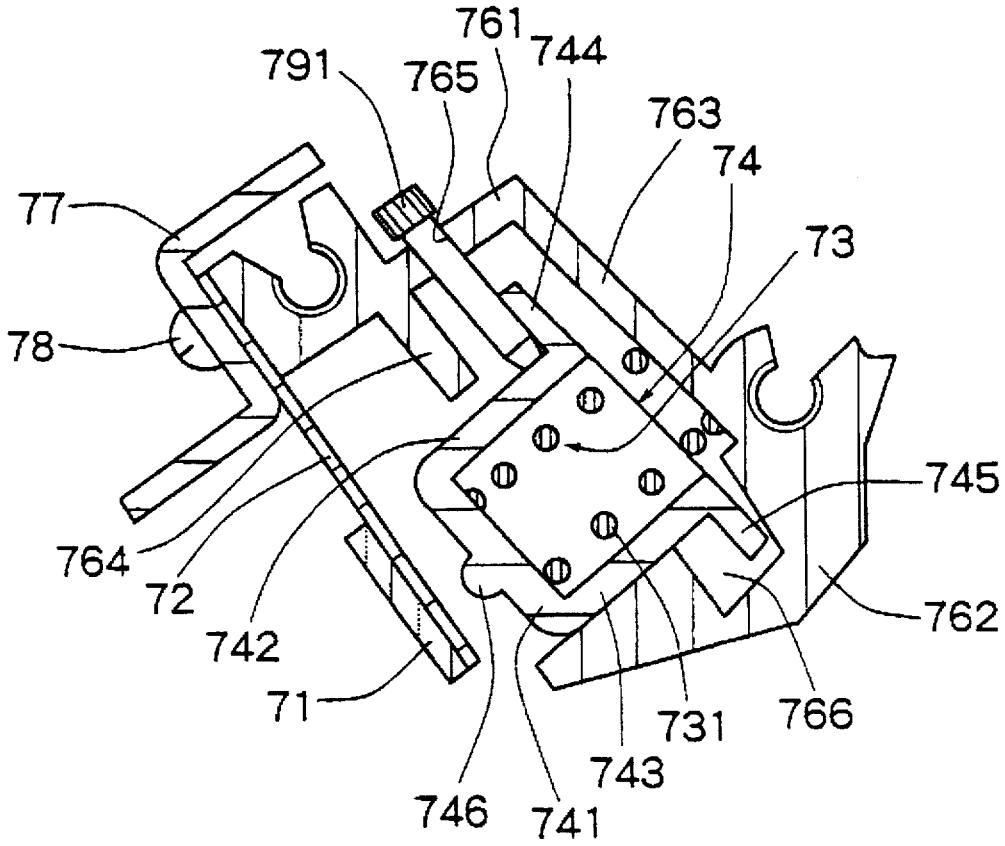
FIG. 7 is a sectional view illustrating an assembly state of the developing agent-limiting means that will be mounted on the device for developing electrostatic latent image shown in FIG. 1.

Described below is the procedure for assembling the developing agent-limiting means 70 and for mounting the developing agent-limiting means 70 in the developing housing 30. In assembling the developing agent-limiting means 70, an end of the compression coil spring 731 is, first, fitted to the spring-fitting chamber 749 of the pushing member 74, as shown in FIG. 6, and while being compressed, the compression coil spring 731 is inserted from an end of the support holder 76 toward the other end of the holder 76. At this time, the guide support portion 744 of the upper side of the pushing member 74 is located between the rear wall 463 and the guide rail 764, and the guide support portion 745 on the lower side is located in the guide groove 766, so that the pushing member 74 is inserted in a predetermined position of the support holder 76 to form the resilient urging means 73. When the resilient urging means 73 is mounted on the support holder 76, as described above, the front wall 741 of the pushing member 74 is pushed toward the rear wall 763 against the force of the compression coil springs 731, so that the guide support portion 744 is moved toward the side of the rear wall 763 beyond the pin-insertion holes 765. In this state, stopper pins 79 are inserted in the pin-insertion holes 765 as shown in FIG. 7, whereby the stopper pins 79 act on the front surface of the guide support portion 764 that constitutes the pushing member 74 to limit the forward motion of the pushing member 74, so that the pushing forces of the compression coil springs 731 no longer act on the back surface of the support plate 72. In the state where the action of the pushing forces of the compression coil springs 731 is canceled, the upper end of the support plate 72 fastened to the other surface of the blade 71 is fitted by screws 78 to the end surface of the upper wall 761 that constitutes the holder 76. The developing agent-limiting means 70 that is assembled in a state where the pushing force acting on the back surface of the support plate 72 is canceled, is disposed at a predetermined position shown in FIG. 1, between the two walls of the developing housing 30 and is mounted using a fastening means such as tightening bolts (not shown) that is fitted penetrating through both walls of the developing housing 30. After the developing agent-limiting means 70 is mounted at the predetermined position in the developing housing 30, the stopper pins 79 are removed from the pin-insertion holes 765, whereby the pushing member 74 is permitted to move forward, i.e., toward the support plate 72, and the protrusion 746 formed on the front surface of the pushing member 74 is pushed onto the back surface of the support plate 72 by the compression coil springs 731. As described above, since the developing agent-limiting means 70 according to the illustrated embodiment is assembled in a state where the pushing force acting on the back surface of the support plate 72 on which the blade 71 is mounted is canceled, the peripheral surface of the developing roller 40 does not suffer damage by the blade 71 at the time of mounting the developing agent-limiting means 70 in the developing housing 30.

The device for developing electrostatic latent image according to the illustrated embodiment is constituted as described above. Mentioned below is the operation. Upon starting the operation of the device for developing electrostatic latent image, the roller 42 of the developing roller 40, roller 52 of the replenishing roller 50 and stirring means 60 are rotated in the directions indicated by arrows by a drive means that are not shown. As the stirring means 60 is rotated in the direction indicated by an arrow 601, the developing agent contained in the stirrer chamber 32 is stirred and is fed into the developing chamber 31. Meanwhile, the used developing agent after held on the peripheral surface of the roller constituting the developing roller 40 and passed through the developing zone 404, is transferred onto the surface of the replenishing roller 50 at a portion where the developing roller 40 and the replenishing roller 50 are in contact with each other, and is mixed in the developing chamber 31 together with the developing agent that is fed by the stirring means 60. The developing agent mixed in the developing chamber 31 is held on the peripheral surface of the roller 52 that is made of a foamed material and constitutes the replenishing roller 50, and is conveyed toward the developing roller 40.

The developing agent held on the peripheral surface of the replenishing roller 50 and conveyed toward the developing roller 40, is supplied to, and is held by, the peripheral surface of the roller 42 constituting the developing roller 40 in the developing agent-holding zone 402, and is conveyed toward the developing agent-limiting zone 403. In the developing agent-limiting zone 403, the blade 71 of the developing agent-limiting means 70 acts on the developing agent held on the peripheral surface of the roller 42 of the developing roller 40, and limits the developing agent held on the peripheral surface of the roller 42 into a predetermined amount to form a thin layer. Here, since the blade 71, support plate 72 and pushing member 74 have flexibility, the one surface of the blade 71 is brought into pressed contact with the surface of the roller 42 of the developing roller 40 uniformly over the whole width even though the shaft of the developing roller 40 may be deflected to some extent.

In the developing zone 404, the developing agent is applied to the electrostatic latent image on electrostatic photosensitive material disposed on the peripheral surface of the rotary drum 2, so that the electrostatic latent image is developed into a toner image. For instance, the electrostatic latent image has a non-imaged region electrically charged to about +600 V and an imaged region electrically charged to about +120 V, and the toner which is the developing agent is adhered to the imaged region (so-called reversal development). The rotary drum 2 is continuously rotated in a direction indicated by an arrow 22 in FIG. 1 and, hence, the peripheral surface of the rotary drum 2 and the peripheral surface of the roller 42 constituting the developing roller 40 move in the same direction in the developing zone 404. The moving speed V2 of the peripheral surface of the roller 42 is set to be slightly larger than the moving speed V1 of the peripheral surface of the rotary drum 2 and it is preferable that a relationship between V1 and V2 is $1.2\ V1 \leqq V2 \leqq 2.2\ V1$. In this case, the developing agent is conveyed in sufficient amounts into the developing zone 404 by the roller 42 of the developing roller 40, the developing agent adhered to the non-imaged portion of the electrostatic latent image is suitably peeled off by the rubbing action of the peripheral surface of the roller 42 with respect to the peripheral surface of the rotary drum 2 and, thus, a good toner image having a suitable developing density and being free from fogging can be obtained. Desirably, the developing agent comprises only a toner having a volume average particle diameter (Vol. 50%: the volume of the toner having sizes smaller than the volume average particle diameter is equal to the volume of the toner having sizes larger than the volume average particle diameter) of from about 8.0 to 12.0 μm and a volume resistivity of not smaller than $10^8$ Ω.cm.

As described above based upon the illustrated embodiment, the device for developing electrostatic latent image of the present invention has a constitution in which the vibration plate having a plurality of developing agent-flow ports is disposed at the developing agent-feed port of the developing housing, and the stirring means is caused to act on the vibration plate. When the stirring means is in operation, therefore, the vibration plate is vibrated at all times. Accordingly, vibration is imparted to the developing agent near the developing agent-feed port, the developing agent is caused to vibrate at all times and it is allowed to decrease the drive torque born by the stirring means and to prevent the developing agent from being solidified near the developing agent-feeding port.

According to the present invention, furthermore, the vibration plate is made of a resilient sheet member and includes a mounting portion and a vibration portion formed continuously to the mounting portion, the vibration portion is provided with a plurality of engaging portions formed in a protruding manner, and the stirring means is caused to act on the plurality of engaging portions. Therefore, the engaging portion that comes into engagement with the stirring means undergoes a resilient deformation, making it possible to reliably produce large vibration.

What we claim is:

1. A device for developing an electrostatic latent image, said device comprising:

a developing housing having a developing chamber, a stirrer chamber and a developing agent-feeding port communicable with said stirrer chamber, a developing roller disposed in said developing chamber to hold, on the peripheral surface thereof, a developing agent in a developing agent-holding zone, and convey the thus held developing agent to a developing zone to apply it to the electrostatic latent image, a replenishing means for feeding the developing agent onto the peripheral surface of said developing roller in the developing agent-holding zone, a stirring means disposed in said stirrer chamber to stir the developing agent that is fed through said developing agent-feeding port and to send the stirred developing agent to said developing chamber, and a vibration plate having a plurality of developing agent-flow ports disposed at said developing agent-feeding port of said developing housing, said stirring means acting on said vibration plate, said vibration plate having a vibration portion and a mounting portion that define a developing agent-flow port therebetween, and said vibration portion having end portions with slits connected with said developing agent-flow port.

2. A device for developing an electrostatic latent image according to claim 1, wherein said vibration plate is made of a resilient sheet member, said vibration portion is provided with a plurality of engaging portions formed in a protruding manner, and said stirring means is caused to act on said plurality of engaging portions.

* * * * *